United States Patent [19]

Oshida

[11] 3,998,665

[45] Dec. 21, 1976

[54] METHOD FOR PRESS WORK OF METALLIC MATERIALS

[75] Inventor: Yoshiki Oshida, Yokohama, Japan

[73] Assignee: Mitsubishi Jukogyo Kabushiki Kaisha, Tokyo, Japan

[22] Filed: Dec. 30, 1974

[21] Appl. No.: 537,391

[52] U.S. Cl. ..... 148/11.5 R; 148/12 R; 148/12 C; 148/12 E; 148/12 EA

[51] Int. Cl.[2] ..... C21D 7/14; C21D 9/48

[58] Field of Search ..... 148/12 R, 12 C, 12 E, 148/12 EA, 36, 37, 11.5 R

[56] References Cited

UNITED STATES PATENTS 3,857,741 12/1974 Hultgren et al. ..... 148/36

*Primary Examiner*—W. Stallard

*Attorney, Agent, or Firm*—Cushman, Darby & Cushman

[57] ABSTRACT

A method for press working of metallic materials is described herein, which method is characterized in that the metallic material is subjected a temperature cycle passing over a transformation point and simultaneously has a light mechanical load applied thereto, so that press forming is carried out while super-plastic phenomena are generated.

5 Claims, 1 Drawing Figure

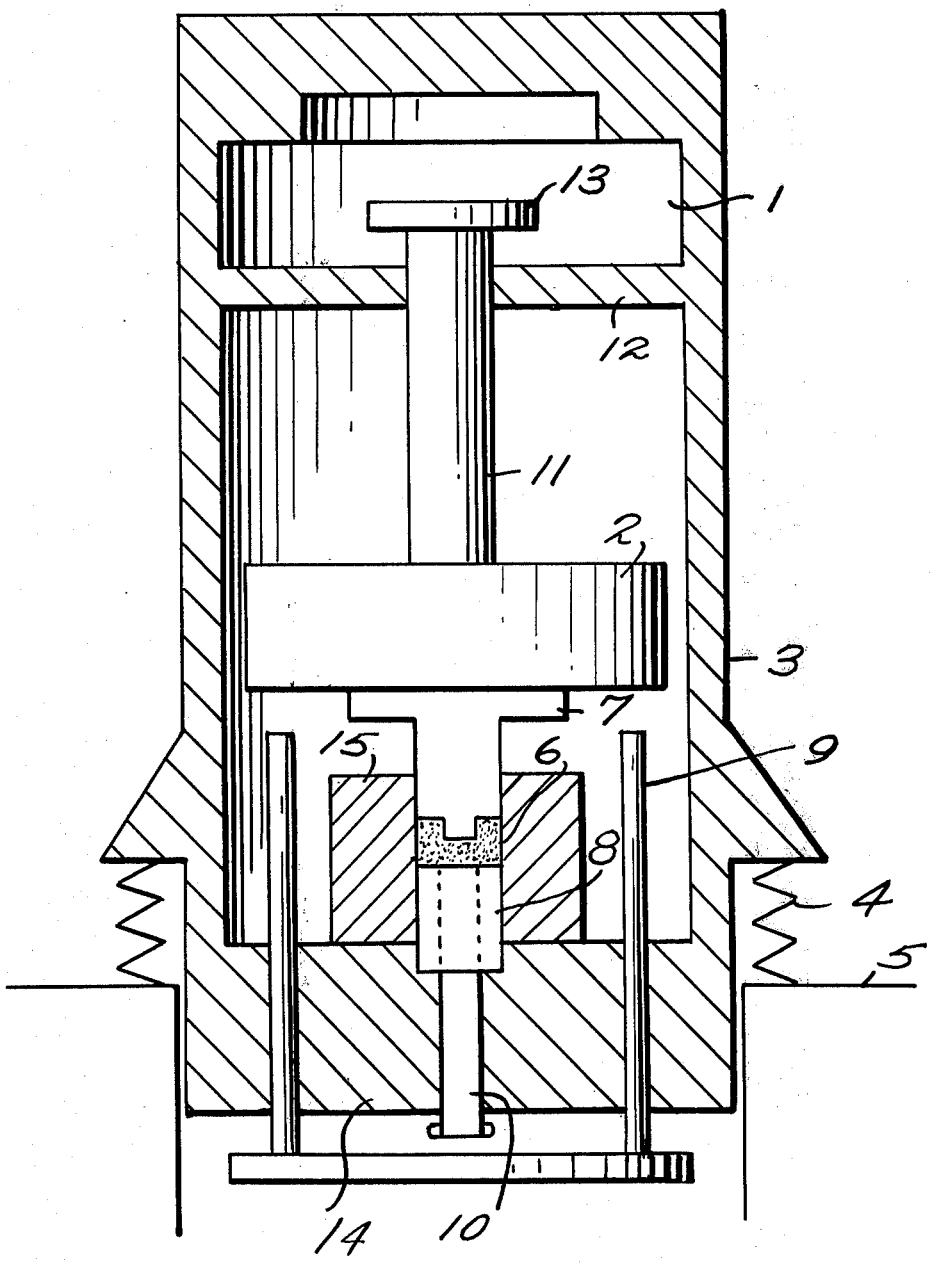
13
1
12
11
2
3
7
15
6
9
8
4
5
14
10

METHOD FOR PRESS WORK OF METALLIC MATERIALS

BACKGROUND OF THE INVENTION

The present invention relates to a method for press working metallic materials by making use of transformation super-plastic phenomena.

Heretofore, in press working of a workpiece made of metallic material such as, for example, stainless steel, for the purpose of increasing the working speed, a method has been generally practiced in which cold working is conducted with a kind of sandpaper sandwiched between a die surface and a workpiece surface. However, such cold press working in the prior art has often encountered disadvantages such that depending upon the sand grain size of the sandpaper sandwiched between the die surface and the workpiece surface, a crack may be generated in the formed portion of the workpiece, especially at a portion relatively larger curvature or a locally thick portion is apt to the produced; and that generation of corrugations may be generated and other problems may occur.

In addition, in the conventional forging process, a very large forging, energy is necessitated and there exists a problem that upon forging loud noise is generated.

The inventor of the present invention had been continuing various experimental researches on the super-plastic behavior of metallic materials, and during that period of time it had been discovered that in relation to the existence of a transformation point in an equilibrium state diagram of metals, metallic material would be elongated with a low stress just as wheat-gluten bodies are under specific conditions. The present invention has been proposed on the basis of the above discovery.

SUMMARY OF THE INVENTION

It is one object of the present invention to provide a novel method for press working metallic articles, which enables one to carry out press working upon metallic material with quite different means from those used in the conventional press working methods, which enables one to perform press working with a fairly small pressure with respect to the pressure required in conventional press working methods, and which enables one to achieve noiseless forging with a very little static pressure energy when the invention is applied to forging.

According to one feature of the present invention there is provided a method for press working metallic materials, characterized in that the metallic material is subjected to a temperature cycle passing over a transformation point and simultaneously a light mechanical load is applied thereto, and thereby press forming is carried out while generating super-plastic phenomena.

Another feature of the invention is to provide the above-featured method for press working metallic materials, in which said temperature cycle has a triangular waveform passing through the transformation point.

BRIEF DESCRIPTION OF THE DRAWING

The above mentioned and other features and objects of this invention will become more apparent by reference to the following description taken in conjunction with the accompanying drawing, in which:

The single FIGURE is a longitudinal cross-sectional view of one example of a forging machine adapted to practice the method according to the present invention.

DETAILED DESCRIPTION OF THE PRESENTLY PREFERRED EMBODIMENT

Now the present invention will be described in more detail with reference to its practical examples:

EXAMPLE 1

A stainless steel plate of about 1.5 mm in thickness is employed as metallic material, and this stainless plate is disposed between upper and lower dies for which a base frame of an existing turning lathe or a base of an existing press is used, to apply a light mechanical load to the stainless steel plate when said upper die while connecting the opposite ends of the stainless steel plate to heating chucks. At this moment, the mechanical load applied to the stainless steel plate could be at stress of, for example, about 1/10 – 1/20 of the yielding point or the maximum durable stress presented by the stainless steel plate with satisfactory results. In view of the fact that the transformation point of the stainless steel plate is at about 1100° C, the upper limit of the heating temperature is set at 1150° C while the lower limit of the cooling temperature is set at 1050° C, and the triangular waveform of temperature cycle is provided by employing, in combination, heating through high frequency induction heating or direct heating by passing a current, and cooling through blowing pressurized air and the like. More particularly, the stainless steel plate is alternately and repeatedly and heated and cooled by continuously applying 3 – 5 cycles (one cycle extending over about 20 seconds) of the triangular waveform temperature cycles, each having its upper and lower limits set at 1150° C and at 1050° C with the transformation point (about 1100° C) of the stainless steel plate intervening therebetween. Thereby the stainless steel plate shows transformation super-plastic phenomena and is converted into a wheat-gluten-like state. If press working is conducted under such a state, then it is possible to work or form a stainless steel plate with a very light mechanical load.

In case of eutectoid steel, since its transformation point ($Ac_1$ transformation point) is at about 720° C, the working is conducted in a similar way to the above-mentioned case of stainless steel, but setting the upper limit of heating temperature at 850° C and the lower limit of cooling temperature at 600° C.

Another example of embodiments of the present invention as applied to a forging process will be described hereinunder with reference to the drawing.

EXAMPLE 2

Referring now to the drawing, a hammer main body 3 is disposed on a foundation 5 via a spring 4. Within the hammer main body 3 is provided a high pressure chamber 1, an axial rod 11 of a ram 2 being slidably fitted in an opening of a partition plate 12, and one end portion 13 of the axial rod 11 is disposed within the high pressure chamber 1. A mould 15 is positioned on a base frame 14 of the hammer main body 3, and at the bottom of the ram 2 is provided an upper die 7. Opposite to the upper die 7, is positioned a lower die 8 within the mould 15, and further there are provided at the bottom of the hammer main body 3, a knock out pin 10 inserted into the lower die 8 through the base frame 14 and ram restoring means 9 extending through the base frame 14. The upper and lower dies 7 and 8 are respectively connected to terminals of an electric power supply (not shown), and a cooling device (not shown) is provided at a position within the mould 15 higher than the upper surface of the lower die 8.

For a workpiece 6 is employed SS41 steel. The workpiece 6 is placed on the lower die 8, and the ram 2 is actuated via the axial rod 11 by the gas pressure within the high pressure chamber 1 is apply a mechanical load to the workpiece 6. In this case, the mechanical load applied to the workpiece 6 could be a stress of about 1/10 – 1/20 of the yielding point of the workpiece material SS41 with satisfactory results, similarly to the case of Example 1, and it could be selected at about 2 $kg/mm^2$. In addition, an electric current is passed between the upper and lower dies 7 and 8 to heat the workpiece 6 up to 850° C, and then the cooling device is actuated to cool the workpiece 6 to the proximity of 600° C, because the transformation point Ac1 of SS41 steel is at 723° C. Otherwise, if the Ac3 transformation point is jointly utilized, then the workpiece 6 is heated up to 950° C. By applying such heating and cooling temperature cycle at a rate of 4 – 5 cycles per minute, press forging can be carried out. Thereafter the workpiece 6 is taken out by means of the knock out pin 10, and the ram 2 is restored to its original position by actuating the ram restoring means 9.

In the above-described embodiment, the variable temperature range of a temperature cycle was selected at about ±50° – 100° C with respect to the transformation point, and the frequency of the temperature cycle was selected at 3 – 5 cycles/minute. The reasons why such values were selected is because they are determined by taking into consideration the variation of the transformation point caused by the change of the heating and cooling speeds as well as the time required from commencement to termination of the transformation. Upon practicing the present invention, the conditions for the temperature cycle passing through the transformation point up and down so as to generate super-plastic phenomena such as, for example, a temperature range and a frequency, can be selected at appropriate values depending upon the properties and shape of the material to be treated. The stress applied to the workpiece could be selected at about 1/10 to 1/20 of the yielding point (a maximum durable stress) of the metallic material.

Therefore, the method according to the present invention can be practiced for any kind of metallic material so long as it is a material having a transformation point in an equilibrium state diagram of metal, and it can be readily achieved by presetting the upper limit of heating temperature and the lower limit of cooling temperature at ±50° C – 200° C with respect to the transformation point of said metallic material which is preselected as a reference temperature (a center temperature), and by placing the workpiece of said metallic material between upper and lower dies. According to this method, press forming can be conducted under a very light load condition in comparison to the conventional cold press working of metallic material, and in some cases such press forming can be achieved satisfactorily only with the weight of the material itself without necessitating application of a mechanical load by means of the upper die. In addition, as clearly distinguished from the conventional cold press working, this method has desirable effects and advantages that the formed material shows no spring-back effect at all, and that the working time can be shortened drastically in fact to within a range of 8 – 5 minutes. In a forging application according to this method, press forging which is free from noise can be easily performed with a lower pressure that required in prior art methods.

While I have described above the principles of my invention in connection with specific embodiments, it is to be clearly understood that this description is made only by way of example and not as a limitation to the scope of my invention as set forth in the accompanying claims.

What is claimed is:

1. A method for working a piece of metallic material which has at least one transformation point by making use of transformation super-plastic phenomena, comprising:

placing the piece of metallic material upon a lower die and peripherally confining the piece with a mould sidewall;

cyclically heating for a half cycle and cooling for a half cycle the piece of metallic material, and in so doing, observing the following constraints:

1. each half-cycle during which the metallic material is heated, it is raised to a temperature that is from about 50° C to about 200° C above said transformation point, and each half-cycle during which the metallic material is cooled, it is lowered to a temperature that is from about 50° C to about 200° C below said transformation point;
2. the metallic material is subjected to at least three of these heating and cooling cycles,
3. each such cycle has a period of about 20 seconds,
4. the temperature is not held at its maximum and minimum value for any significant length of time;

and further including:

simultaneously with the cyclical heating and cooling, applying an upper die upon the piece of metallic material, in opposition to the lower die, and forcing one die toward the other sufficiently to apply to the piece of metallic material a light mechanical load of up to about 1/20 to 1/10 the yielding stress of said material.

2. The method of claim 1, wherein:

the metallic material is steel;

the transformation point is its $Ac_1$ transformation point at 723° C;

in the heating half cycles, the metallic material is heated to an upper limit of 850° C, and in the cooling half cycles, the metallic material is cooled to a lower limit of 600° C.

3. The method of claim 2, wherein the steel is SS41 steel.

4. The method of claim 1, wherein:

the metallic material is steel;

the at least one transformation point is both its $Ac_1$, transformatin point at 723° C and its $Ac_3$ transformation point at 850° C;

in the heating half cycles, the metallic material is heted to an upper limit of 950° C; and in the cooling half cycles, the metallic material is cooled to a lower limit of 600° C.

5. The method of claim 1, wherein:

the metallic material is stainless steel;

the transformation point is at 1100° C; and in the heating half cycles, the metallic material is heated to an upper limit of 1150° C; and in the cooling half cycles, the metallic material is cooled to a lower limit of 1050° C.

* * * * *